US007519320B2

(12) United States Patent
Aoki et al.

(10) Patent No.: US 7,519,320 B2
(45) Date of Patent: Apr. 14, 2009

(54) IMAGE HEATING APPARATUS IN WHICH HEATER FOR HEATING HEAT ROLLER IS OUTSIDE HEAT ROLLER

(75) Inventors: Daisuke Aoki, Numazu (JP); Satoshi Nishida, Numazu (JP); Masao Amano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 11/552,708

(22) Filed: Oct. 25, 2006

(65) Prior Publication Data

US 2007/0098465 A1 May 3, 2007

(30) Foreign Application Priority Data

Oct. 31, 2005 (JP) ..... 2005-317222

(51) Int. Cl.
*G03G 15/20* (2006.01)

(52) U.S. Cl. ..... 399/328; 399/122

(58) Field of Classification Search ..... 399/107, 399/110, 122, 320, 328, 330, 331; 219/619
See application file for complete search history.

(56) References Cited

U.S. PATENT DOCUMENTS

| | | | | |
|---|---|---|---|---|
| 6,088,549 | A | 7/2000 | Kagawa et al. | |
| 6,763,205 | B2 | 7/2004 | Izawa et al. | |
| 6,961,533 | B2 | 11/2005 | Sano et al. | |
| 6,985,689 | B2 | 1/2006 | Nanataki et al. | |
| 7,162,194 | B2 * | 1/2007 | Hotta et al. | 399/328 |
| 7,203,438 | B2 | 4/2007 | Omata et al. | 399/69 |
| 7,269,365 | B2 * | 9/2007 | Mochizuki et al. | 399/33 |
| 7,277,650 | B2 * | 10/2007 | Ihara et al. | 399/67 |
| 2003/0077092 | A1 | 4/2003 | Ogawa et al. | 399/328 |
| 2004/0202497 | A1 | 10/2004 | Hotta et al. | |
| 2005/0169656 | A1 | 8/2005 | Nihonyanagi et al. | |
| 2005/0207770 | A1 | 9/2005 | Nihonyanagi et al. | |
| 2006/0051117 | A1 | 3/2006 | Nishida | 399/69 |

FOREIGN PATENT DOCUMENTS

| | | |
|---|---|---|
| JP | 06-075491 | 3/1994 |
| JP | 08-129313 | 5/1996 |
| JP | 10-133505 | 5/1998 |
| JP | 10-232577 | 9/1998 |
| JP | 11-024461 | 1/1999 |
| JP | 11-024489 | 1/1999 |
| JP | 2002-123117 | 4/2002 |
| JP | 2002-221219 | 8/2002 |
| JP | 2002-236426 | 8/2002 |
| JP | 2003-029563 | 1/2003 |
| JP | 2003-114583 | 4/2003 |

(Continued)

*Primary Examiner*—Hoan H Tran
(74) *Attorney, Agent, or Firm*—Fitzpatrick, Cella, Harper & Scinto

(57) ABSTRACT

An image heating apparatus includes a rotatable member contactable to a recording material for carrying an image; a heating member contacted to an outer surface of the rotatable member to heat the rotatable member; a holding member for holding the heating member; and an urging member for urging the holding member to contact the heating member to the rotatable member, wherein the holding member is rotatable relative to the apparatus about an axis parallel with a generating line of the rotatable member.

5 Claims, 5 Drawing Sheets

FOREIGN PATENT DOCUMENTS

| | | |
|---|---|---|
| JP | 2003-186327 | 7/2003 |
| JP | 2003-270985 | 9/2003 |
| JP | 2003-295652 | 10/2003 |
| JP | 2004-138856 | 6/2004 |
| JP | 2004-157524 | 6/2004 |
| JP | 2004-178888 | 6/2004 |
| JP | 2004-179041 | 6/2004 |
| JP | 2004-258536 | 9/2004 |
| JP | 2004-279857 | 10/2004 |
| JP | 2004-280083 | 10/2004 |
| JP | 2005-250452 | 9/2005 |
| JP | 2005-250453 | 9/2005 |

* cited by examiner

IMAGE HEATING APPARATUS IN WHICH HEATER FOR HEATING HEAT ROLLER IS OUTSIDE HEAT ROLLER

FIELD OF THE INVENTION AND RELATED ART

The present invention relates to an image heating apparatus suitable as a thermal fixing apparatus to be mounted in an image forming apparatus such as a copying machine, a printer, etc. In particular, the present invention relates to an image heating apparatus, the heater of which for heating the heat roller is disposed outside the heat roller.

An image forming apparatus, which uses an electrophotographic process, an electrostatic recording process, or the like, forms an unfixed toner image on recording medium (transfer paper, printing paper, photosensitive paper, electrostatic recording paper, etc.), by directly transferring an unfixed toner image formed on an image bearing member onto the recording medium, or indirectly transferring the unfixed toner image onto the recording medium by way of an intermediary transfer member, and then, thermally fixes the unfixed toner image on the recording medium with the use of a fixing apparatus. As a fixing apparatus such as the above described one, various fixing apparatuses have been known, for example, a fixing apparatus which employs a heat roller, a fixing apparatus which employs a heating film, etc.

There has been proposed an apparatus, in which the heater for heating the fixation roller is disposed outside the fixation roller, and the toner on recording medium is heated with the use of the heat stored in the fixation roller, the temperature of which is increased by the heat generated by the heater disposed outside the fixation roller (for example, Japanese Laid-open Patent Application 2002-236426). A heating method such as the abovementioned one is called external heating method. As a fixing apparatus which employs the external heating method, there have been devised fixing apparatuses of the contact type, in which the heater is placed in contact with the peripheral surface of the fixation roller, and fixing apparatuses of the noncontact type, in which the heater is not placed in contact with the peripheral surface of the fixation roller. In consideration of the efficiency with which heat is supplied from the heater to the fixation roller, the fixing apparatuses of the contact type seem superior.

As to the structural arrangement for guiding a heater to a fixation roller in a fixing apparatus of the contact type which uses the external heating method, it is possible to provide the fixing apparatus with a heater guide (guide of slide type), which keeps the heater pressed upon the fixation roller, toward the axial line of the fixation roller, with the use of a pressure applying member such as a spring.

However, structuring the guide so that the heater is kept pressed toward the axial line of the fixation roller suffers from the following problems, which will be described next. FIGS. 4 and 5 show an example of a fixing apparatus structured to guide the heater to the fixation roller, with the use of a guide of the slide type.

FIG. 4 shows the fixing apparatus, in which the fixation roller 101 is not being driven, and FIG. 5 shows the fixing apparatus, in which the fixation roller 101 is being driven.

The fixation roller 101 is rotatably supported by the main assembly of the fixing apparatus. It is rotatable by the driving force from an unshown driving force source. The pressure application roller 102, which is a pressure applying means, is supported by the main assembly so that not only is it rotatable, but also, it is vertically movable. It is kept pressed upon the fixation roller 101 by a pressure application spring 106. The recording medium on which a toner image is borne is heated while it is conveyed between the fixation roller 101 and pressure application roller 102 while remaining pinched by the two rollers.

The heater 103, which is a heating means, is held by the heater holder 104, which is vertically movable relative to the wall 107, and to which the heater 103 is attached with the use of adhesive, for example. The heater 103 is kept pressed upon the fixation roller 101 by the pressure applied by the heater spring 105, with the heater holder 104 positioned between the heater spring 105 and fixation roller 101. In order to allow the heater holder 104 to vertically move, a gap G has to be provided between the heater holder 104 and wall 107.

Referring to FIG. 5, as the fixation roller 101 rotates in the direction A in the drawing, the heater 103 is subjected to frictional force which acts in the direction X in the drawing, causing the heater holder 104 to tilt as shown in FIG. 5. As a result, the width (N) of the nip between the heater 103 and fixation roller 101 reduces to ($N-\alpha$), making it harder for the heat from the heater 104 to transfer to the fixation roller 101.

Further, as the heater holder 104 tilts, frictional resistance is generated between the heater holder 104 and wall 107. As a result, the contact pressure between the heater 103 and fixation roller 101 reduces to ($F-\beta$), making it harder for the heat from the heater 103 to transfer to the fixation roller 101. The amount of $\alpha$ and $\beta$ are affected by component tolerance. This makes fixing apparatuses different in the efficiency with which heat is transferred from the heater 103 to the fixation roller 101.

The normal nip width (X) between the fixation roller 101 and heater 103 is defined as the nip width measured when the fixation roller 101 is not rotating (in the state shown in FIG. 4). Further, the normal nip pressure F is defined as the nip pressure measured also when the fixation roller 101 is not rotating. The amount by which heat is applied, or the like value, is set assuming that the nip has the normal width and normal pressure. Therefore, if the nip width reduces to the abovementioned value, the length of time the heater 103 is heated becomes insufficient.

As a result, the heat from the heater 103 fails to transfer to the fixation roller by the preset amount. Therefore, the temperature of the fixation roller 101 does not rise high enough to ensure that a toner image is satisfactorily fixed.

SUMMARY OF THE INVENTION

The present invention was made in consideration of the above described problems, and its primary object is to provide an image heating apparatus, in which the width of the contact area between its heater and fixation roller remains within the preset range.

According to an aspect of the present invention, there is provided an image heating apparatus comprising a rotatable member contactable to a recording material for carrying an image; a heating member contacted to an outer surface of said rotatable member to heat said rotatable member; a holding member for holding said heating member; and an urging member for urging said holding member to contact said heating member to said rotatable member, wherein said holding member is rotatable relative to said apparatus about an axis parallel with a generating line of said rotatable member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
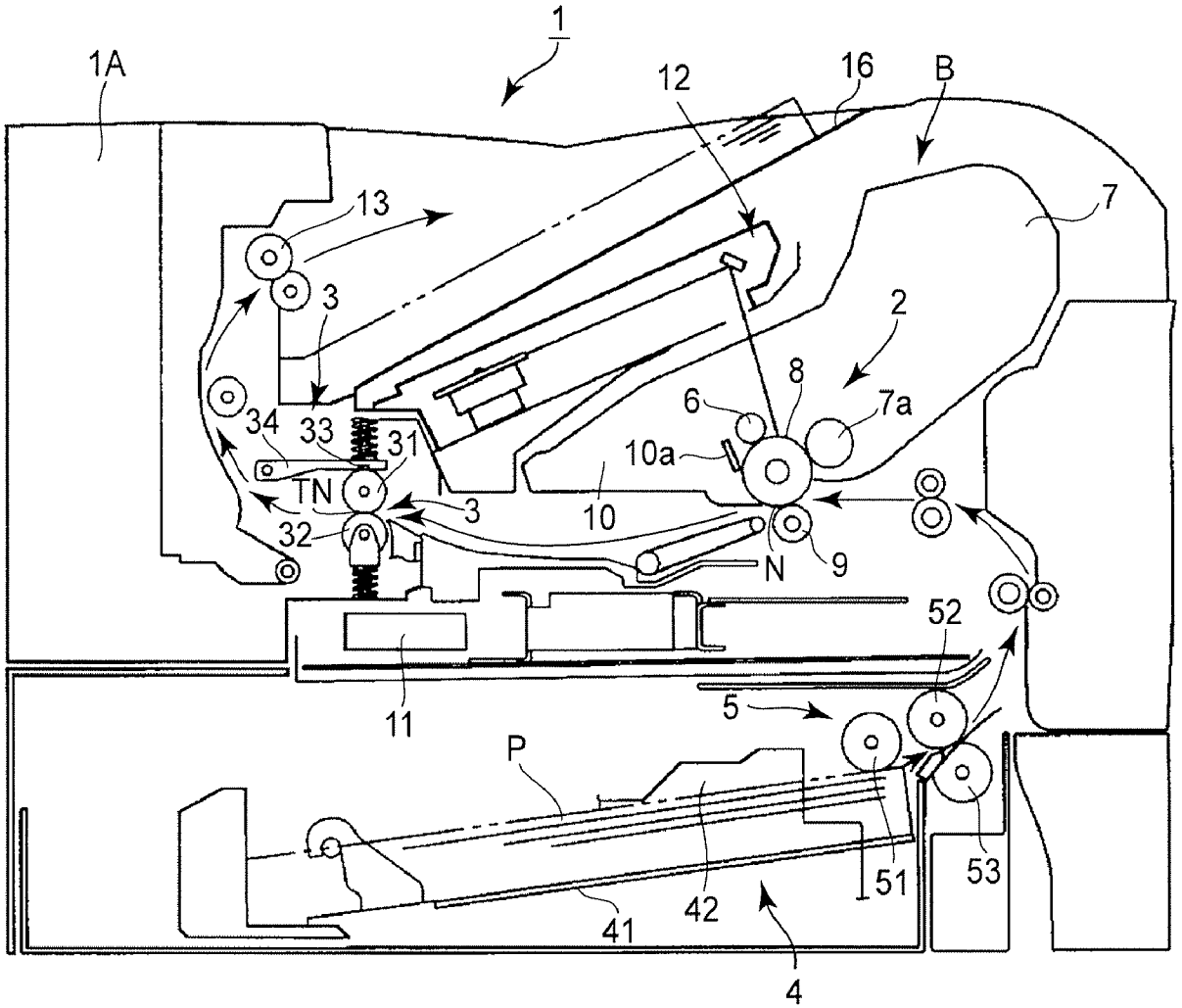
FIG. 1 is a sectional view of a laser beam printer which has an image heating apparatus in accordance with the present invention.

FIG. 1 is a sectional view of a laser beam printer which has a fixing apparatus, that is, an example of an image forming apparatus in accordance with the present invention, showing the general structure thereof.

Referring to FIG. 1, a laser beam printer 1 has: a sheet cassette 4 in which multiple sheets P, which are recording mediums on which an image is recorded, are stored in layers; a sheet feeding apparatus 5 which feeds the sheets P into the main assembly of the printer 1 while separating the sheets P one by one; and an image forming section 2 which forms an image on the sheets P sent to the image forming section 2 by the sheet feeding apparatus 5. In addition, the image forming apparatus 1 is provided with a fixing apparatus 3 which thermally fixes the unfixed toner image formed on each sheet P by the image forming section 2.

The sheet cassette 4 is provided with a bottom plate 41, a sheet regulating plate 42, etc. The bottom plate 41 is rotatably supported by the sheet cassette 4. The sheet regulating plate 42 is for regulating the sheet P in position in terms of the direction perpendicular to the direction in which the sheet P is conveyed. The sheet cassette 4 is removably mountable in the main assembly 1A of the image forming apparatus 1, in the direction, for example, perpendicular to the abovementioned sheet conveyance direction.

The sheet feeding apparatus 5 is provided with a pickup roller 51, a feed roller 52, a retard roller 53, etc. The pickup roller 51 and feed roller 52 constitute a sheet feeding means, and the retard roller 53 constitutes a sheet separating means.

The image forming section 2 has an electrophotographic photosensitive member 8 (which hereafter will be referred to as "photosensitive drum"), which is an image bearing member in the form of a drum. In the adjacencies of the peripheral surface of the photosensitive drum 8, a charge roller 6 and a laser scanner unit 12 are disposed. The charge roller 6 is a charging means. The laser scanner unit 12 is an exposing means for forming a latent image on the peripheral surface of the photosensitive drum 8 by projecting an optical image onto the peripheral surface of the photosensitive drum 8. The charge roller 6 is placed in contact with the peripheral surface of the photosensitive drum 8 so that it is rotated by the rotation of the photosensitive drum 8. It uniformly charges the peripheral surface of the photosensitive drum 8 as the photosensitive drum 8 rotates.

Also in the adjacencies of the peripheral surface of the photosensitive drum 8 is a developing apparatus 7 is disposed, which has a development roller 7*a*, which is a developing means for developing the latent image formed on the peripheral surface of the photosensitive drum 8 into a toner image. The development roller 7*a* supplies the development area of the peripheral surface of the photosensitive drum 8 with toner to develop the latent image formed on the photosensitive drum 8.

Also disposed in the adjacencies of the peripheral surface of the photosensitive drum 8 are a transfer roller 9 and a cleaning apparatus 10. The transfer roller 9 is a transferring means which transfers the toner image on the photosensitive drum 8 onto the sheet P. The cleaning apparatus 10 is a cleaning means which removes the toner remaining on the peripheral surface of the photosensitive drum 8 after the transfer of the toner image. The cleaning apparatus 10 has a cleaning blade 10*a*.

In this embodiment, the photosensitive drum 8, charging means 6, developing means 7, and cleaning means 10 are integrally placed in a cartridge, forming thereby a process cartridge B, which is removably mountable in the apparatus main assembly 1A.

The image forming apparatus 1 is also provided with a fixing apparatus 3, which thermally fixes the toner image on the sheet P to the sheet P, in its fixation nip TN.

The fixing apparatus 3 is provided with a fixation roller 31 (rotatable member), a heater 33, a pair of arms 34 (holders), a pressure roller 32, etc. The heater 33 is a heating member, which is kept pressed directly upon the fixation roller 31 to heat the fixation roller 31. The arms 34 hold the heater 33. The pressure roller 32 forms the fixation nip TN by being pressed upon the fixation roller 31.

After the fixation of the toner image to the sheet P, the sheet P is discharged by a pair of discharge rollers 13 into a delivery tray, in which the sheets P are deposited in layers.

Further, the image forming apparatus 1 is provided with a control section 11 which controls the image forming operation of the apparatus 1.

Next, the image forming operation carried out by the image forming apparatus structured as described above will be described.

As image information is sent to the laser beam printer 1 from an unshown personal computer, or the like, an unshown controller board, which processes the image information sent thereto, outputs a print signal. As the print signal is outputted, the sheets P, which have been stored in layers in the sheet cassette 4, are fed one by one into the apparatus main assembly 1A by the pickup roller 51, feed roller 52, and retard roller 53, and then, are sent to the nip N between the photosensitive drum 8 and transfer roller 9 in the process cartridge B.

In another part of the apparatus, at the same time as the print command is outputted, a beam of laser light is projected from the laser scanner unit 12 onto the peripheral surface of the photosensitive drum 8 while being modulated with the digitized image information. As a result, a latent image which is in accordance with the digitized image information is formed on the peripheral surface of the photosensitive drum 8. Then, a toner image is formed on the peripheral surface of the photosensitive drum 8 by developing this latent image.

Then, the toner image formed on the photosensitive drum 8 is transferred onto the sheet P while the sheet P is conveyed through the nip N between the photosensitive drum 8 and transfer roller 9. After the transfer of the toner image onto the sheet P, the sheet P is sent to the fixing apparatus 3, in which the sheet P and the toner image thereon are subjected to heat and pressure. As a result, the toner image becomes virtually permanently fixed to the sheet P. Thereafter, the sheet P bearing the fixed toner image is discharged by the pair of discharge rollers 13 into the delivery tray 16, in which the sheets P are deposited in layers.

Figure 2:
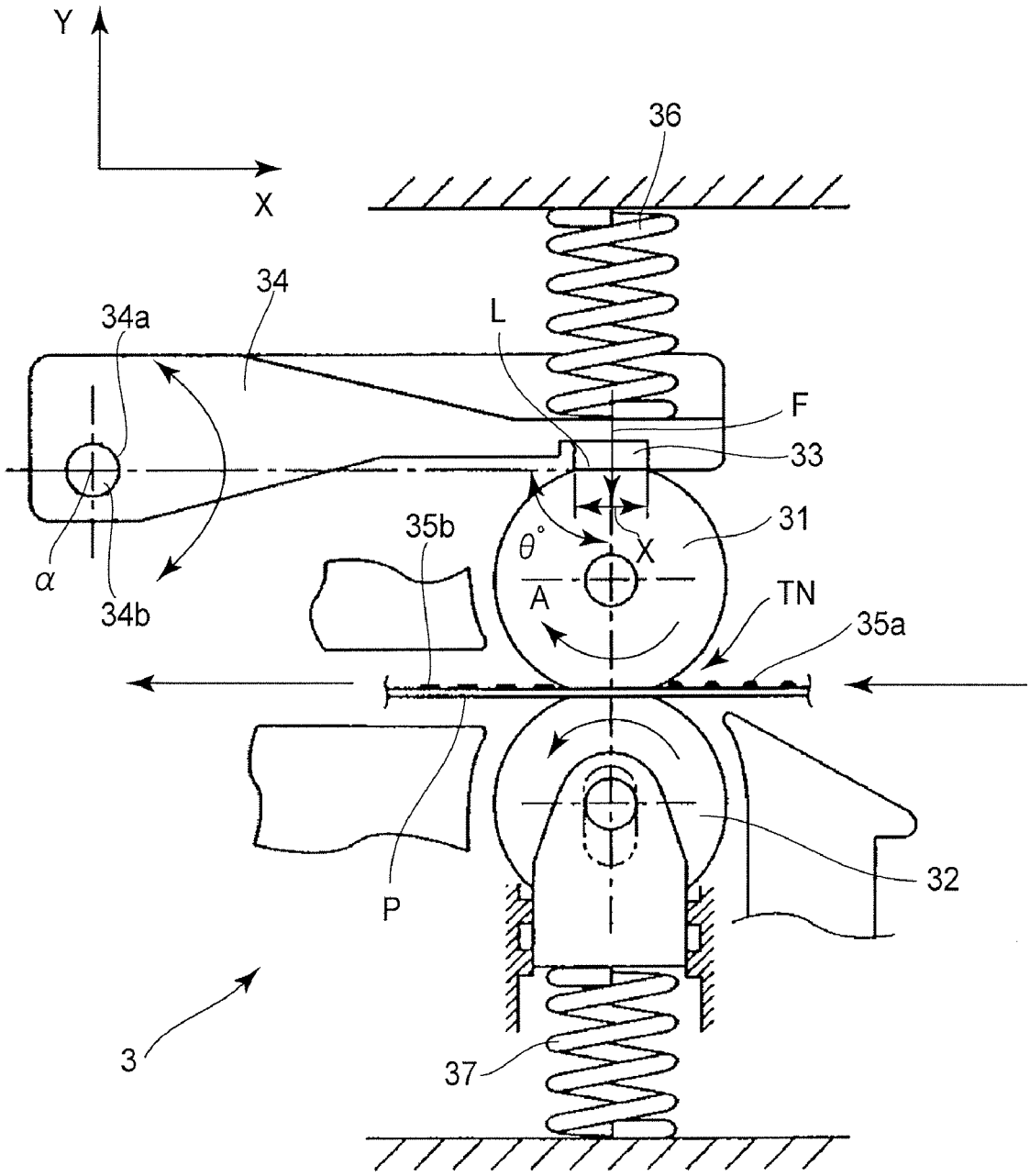
FIG. 2 is a sectional view of an image heating apparatus, in accordance with the present invention, in which the shaft for supporting the arm is on the upstream side of the heating nip, in terms of the rotational direction of the fixation roller.

At this time, this embodiment will be described in detail with reference to FIG. 2, which is a detailed drawing of the fixing apparatus 3, which is as an example of an image heating apparatus in accordance with the present invention.

As described above, in this embodiment, the fixing apparatus 3 is provided with the fixation roller 31 (rotatable member), heater 33 for heating the fixation roller 31, pair of arms 34 (holders) for holding the heater 33, and pressure roller 32 for forming the fixation nip TN by being pressed upon the fixation roller 31.

The fixation roller 31 is rotatably supported by the apparatus main assembly 1A. It can rotate in the direction A in the drawing, by receiving the driving force from the unshown driving force source of the apparatus main assembly 1A. The fixation roller 31 is made up of a metallic core, and an elastic layer formed on the peripheral surface of the metallic layer. The elastic layer is formed of silicone rubber.

The arms 34 are formed of heat resistant plastic, such as liquid polymer. They are supported by the apparatus main assembly 1A so that they can be rotationally moved about its rotational axis $\alpha$.

The heater 33 is a carbon heater, a ceramic heater, or the like. It is a heating member which generates heat as electricity is flowed through it by an unshown electric power source. Further, the heater 33 is solidly attached to the arms 34 with the use of adhesive or the like. Further, the heater 33 is kept pressured toward the fixation roller 31 by a pair of springs 36 (pressure applying members), which are attached to the apparatus main assembly 1A so that they apply pressure to the arms 34 in the direction to rotate the arms 34. Therefore, the heater 33 is kept pressed upon the fixation roller 31. Further, the fixation roller 31 is provided with the elastic layer as described above. Therefore, the heater 33 and fixation roller 31 form the heating nip (X), which is preset in width and internal pressure (F).

The fixing apparatus 3 is designed so that the rotational axis $\alpha$ is in the imaginary plane which includes the plane L (heating surface) of the nip between the fixation roller 31 and heater 33 ($\theta$=90° (FIG. 2)) Also, the fixing apparatus 3 in this embodiment is designed so that the rotational axis $\alpha$ is on the upstream side of the heating surface L, in terms of the rotational direction of the fixation roller 31. Therefore, even when the fixation roller 31 rotates, and therefore, the heater 33 is subjected to the force generated in the direction +X by the friction between the fixation roller 31 and heater 33, the moment which otherwise would have rotated the heater 34 about the rotational axis $\alpha$ does not occur. That is, it is only the pressure generated by the spring 36 that is present between the fixation roller 31 and heater 33. Therefore, even if the fixation roller 31 rotates, the amount of the contact pressure F between the fixation roller 31 and heater 33 does not change, neither does the width X of the nip between the fixation roller 31 and heater 33.

In this embodiment, the fixing apparatus 3 is designed so that the rotational axis $\alpha$ is in the imaginary plane which includes the nip line L between the fixation roller 31 and heater 33 ($\theta$=90°). However, even if $\theta$=90°, as long as the coefficient of friction between the fixation roller 31 and heater 33 can be obtained, the amount of the contact pressure F between the fixation roller 31 and heater 33 can be easily calculated based on the balance between force and moment. Further, the nip width X can be obtained from the obtained contact pressure F. Therefore, theoretically, it is possible to manufacture a fixing apparatus, the $\theta$ of which is not 90°, and yet, the contact pressure F and nip width X of which remain at their preset values while the fixation roller 31 rotates.

However, the coefficient of friction between the fixation roller 31 and heater 33 is likely to change in response to temperature change. Further, it is also likely to change due to the surface deterioration of the fixation roller 31 and heater 33 which occur because the fixation roller 31 rubs the heater 33 as it rotates. Therefore, it is difficult to obtain the exact coefficient of friction between the fixation roller 31 and heater 33. Therefore, it is preferable that $\theta$ is set to 90°.

Figure 3:
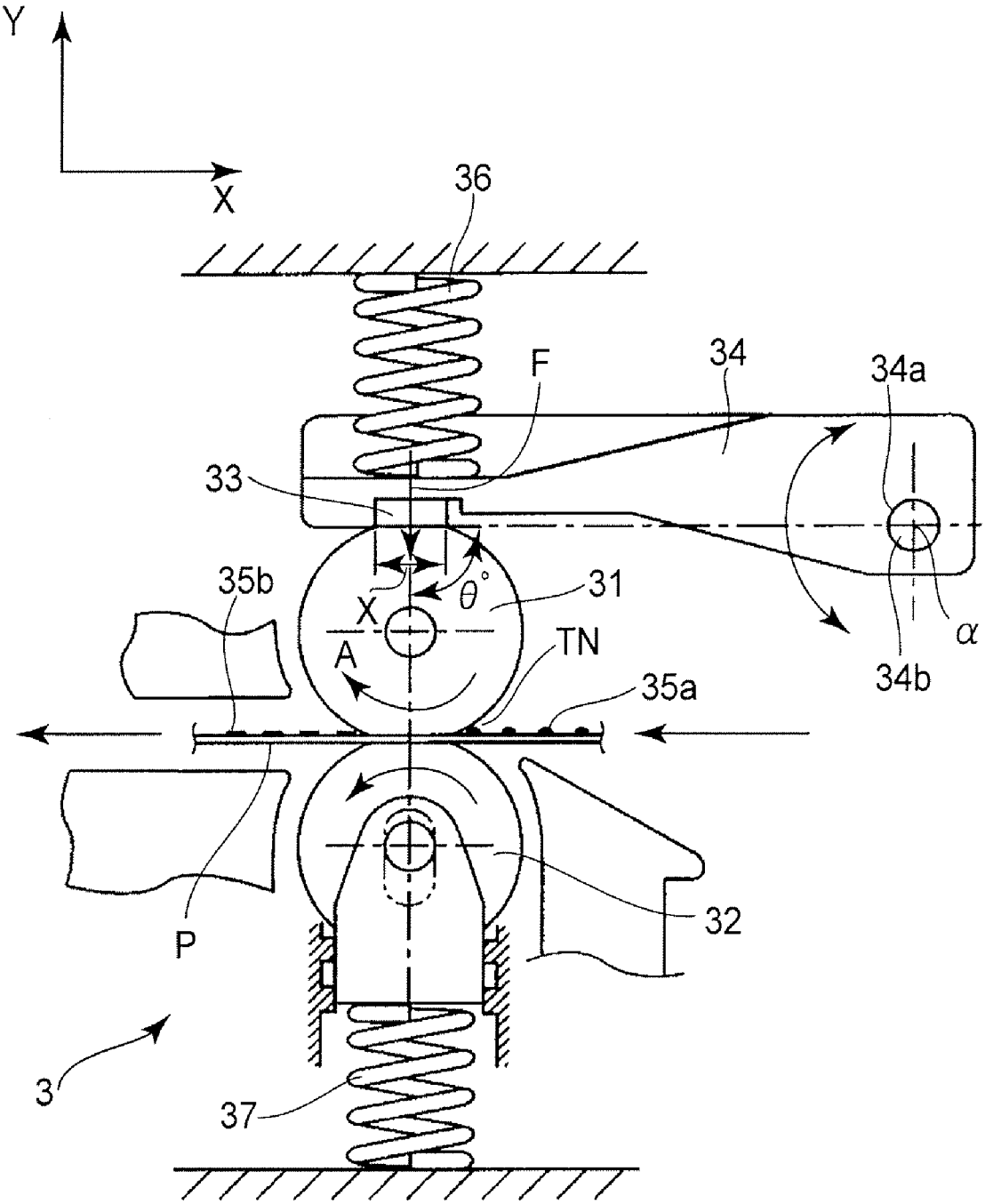
FIG. 3 is a sectional view of another image heating apparatus in accordance with the present invention, in which the shaft for supporting the arm is on the downstream side of the heating nip, in terms of the rotational direction of the fixation roller.
Figure 4:
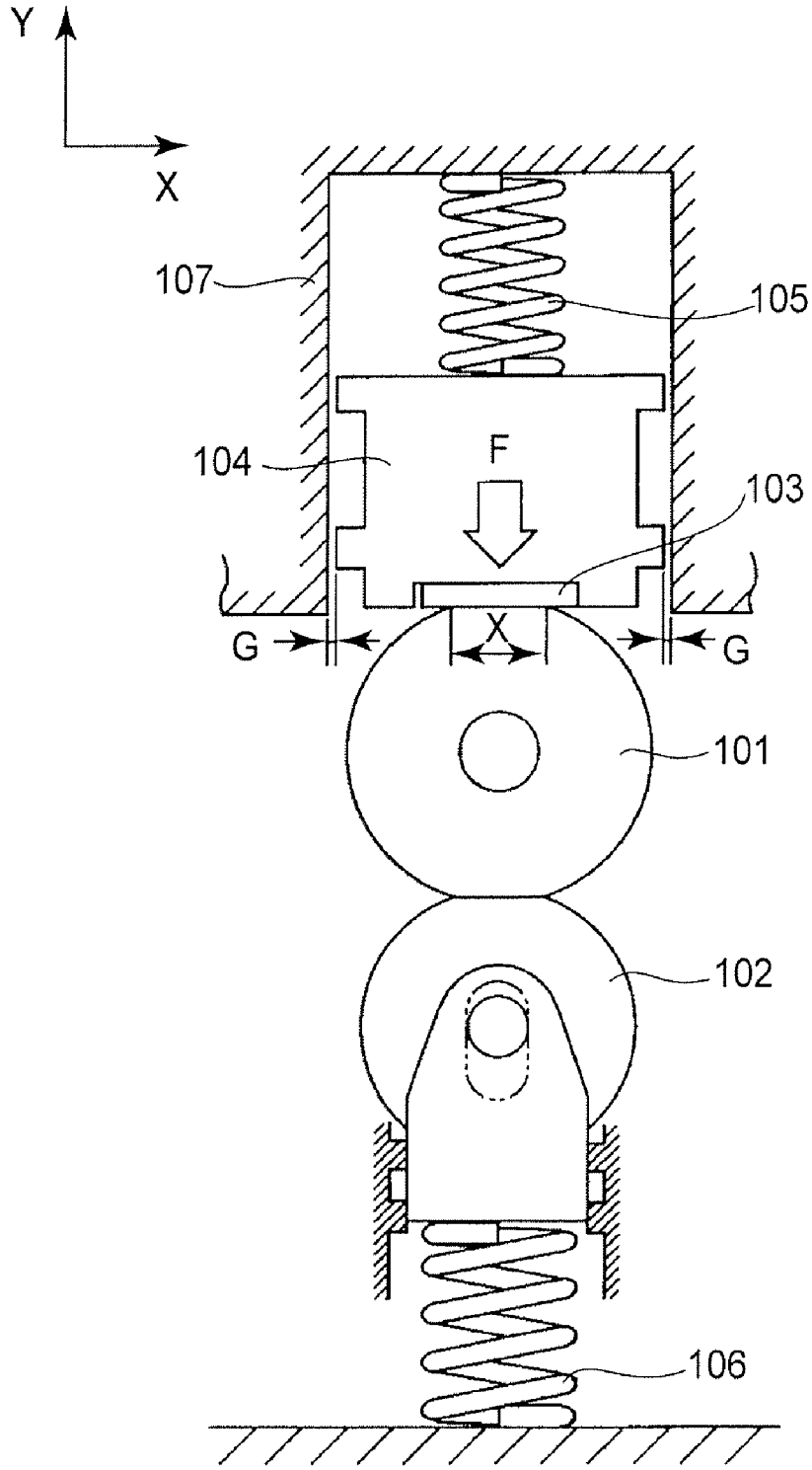
FIG. 4 is a sectional view of a fixing apparatus, in which is the heater guide is slidably movable, and the fixation roller is not rotating.
Figure 5:
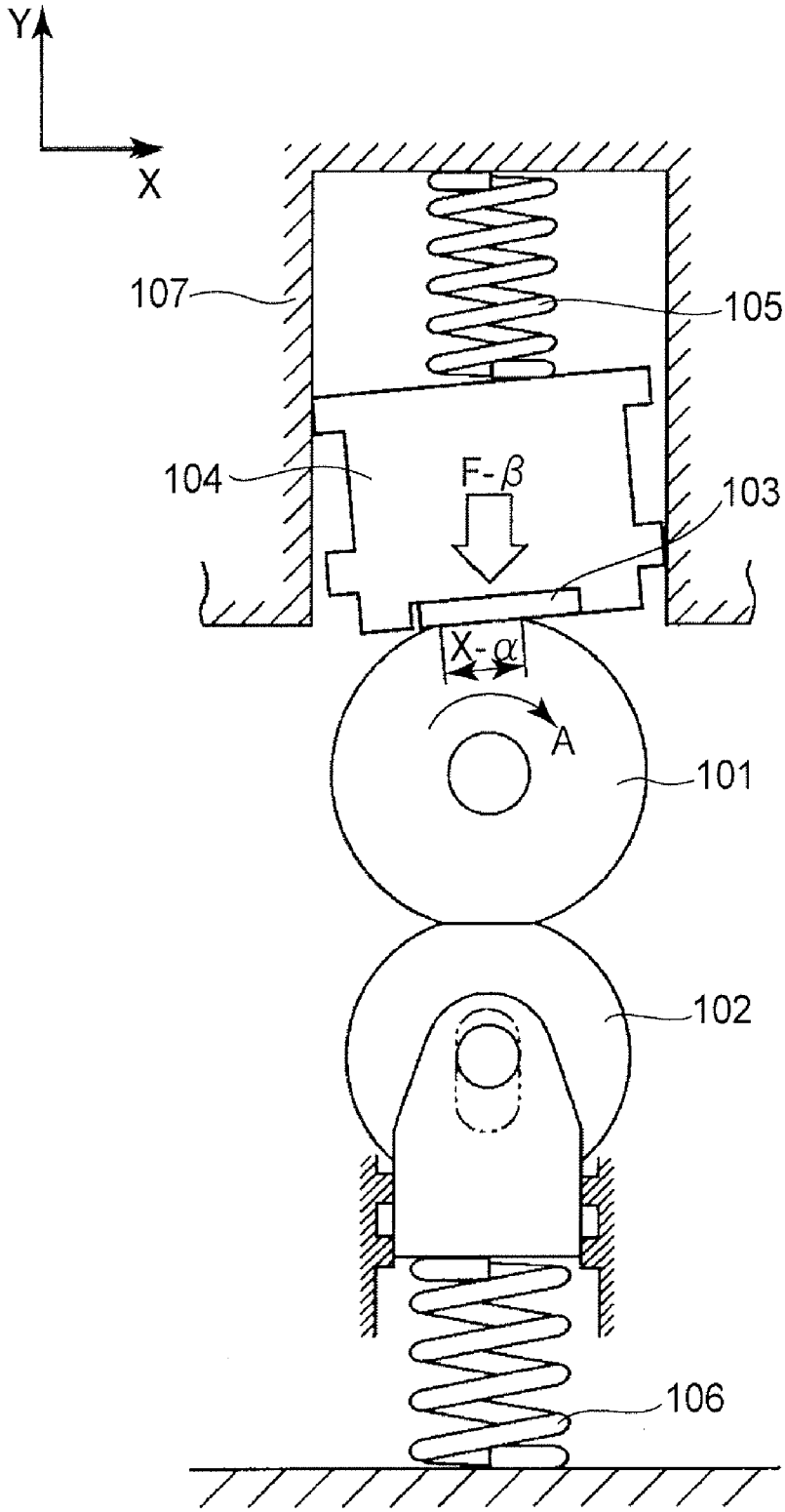
FIG. 5 is a sectional view of a fixing apparatus, in which the heater guide is slidably movable and the fixation roller is rotating.

Referring to FIG. 3, the fixing apparatus 3 may be designed so that the rotational axis $\alpha$ is on the downstream side of the heating surface L, in terms of the rotational direction of the fixation roller 31. Also in this case, the moment which causes the heater holder 34 to rotate about the rotational axis $\alpha$ is not generated (FIG. 3 shows the case in which $\theta$=90°). Further, the amount of the contact pressure F and the nip width X can be calculated based on the balance between force and moment. Therefore, theoretically, it is possible to make a fixing apparatus, in which $\theta$ is not 90°, the rotational axis $\alpha$ is on the upstream downstream side of the heating surface L, in terms of the rotational direction of the fixation roller 31, and yet, the rotation of the fixation roller 31 does not change the amount of the contact pressure F and the nip width F from their preset values.

Regarding the attachment of the arms 34 (heater holders) to the apparatus main assembly 1A, in this embodiment, in order to rotatably support the arms 34 with the apparatus main assembly 1A, the arms 34 are provided with a hole 34*a*, and the apparatus main assembly 1A is planted with a pair of shafts 34*b*.

As for the measurements of the hole 34*a* and shaft 34*b*, for example, the hole 34*a* and shaft 34*b* are 8 mm and 7.5 mm, respectively, in diameter, providing a play between the arm 34*a* and shaft 34*b*. The provision of this play affords the arm 34 more latitude in movement, because of the equalizing function. Therefore, even if the arms 34, fixation roller 31, etc., are not exact in measurement because of manufacture tolerance, the arms 34 are allowed to smoothly follow the movement of the fixation roller 31. Therefore, the contact pressure F between the fixation roller 31 and heater 33, and the nip width X, remain stable.

As to the pressure roller 32, it is supported with the apparatus main assembly 1A so that not only is the pressure roller 32 allowed to rotate, but also, vertically move. Further, it is kept pressed upon the fixation roller 31 by a preset amount of pressure applied by the pressure application springs 37 attached to the apparatus main assembly 1A.

As described above, the fixation roller 31 is provided with the elastic layer. Therefore, the fixation roller 31 and pressure roller 32 together form the fixation nip TN, which has a preset width in terms of the direction in which the sheet P is conveyed. The sheet P is delivered from the image forming section 2 to the fixation nip TN, and is conveyed through the fixation nip TN while remaining pinched by the fixation roller 31 and pressure roller 32.

Further, because the fixation roller 31 is provided with the elastic layer, the pressure roller 32 does not need to be provided with an elastic layer, although it may be provided with an elastic layer. In this embodiment, the pressure roller 32 is circular in cross-section, and the fixing apparatus 3 is structured so that the pressure roller 32 is rotated by the rotation of the fixation roller 31. However, the fixing apparatus 3 may be structured so that the pressure roller 32 receives driving force from the apparatus main assembly 1A and the fixation roller 31 is rotated by the rotation of the pressure roller 32.

After the formation of an unfixed toner image 35*a* on the sheet P by the image forming section 2, the sheet P is sent to the fixing apparatus 3. Then, the toner image 35*a* on the sheet P is heated, in the fixation nip TN between the fixation roller 31 and pressure roller 32, by the heat from the fixation roller 31 heated by the heater 33. As a result, after the sheet P is conveyed through the fixation nip TN, the toner image 35*a* becomes virtually permanently fixed to the sheet P; it turns into a toner image 35*b*.

As described above, the structural arrangement, in this embodiment, for the fixing apparatus can keep the heating member in contact with the rotatable member so that the contact pressure between the heating member and rotatable member, and the width of the nip formed between the heating member and rotatable member, remain at their preset values, preventing thereby the toner image from being under-fixed.

Also as described above, according to this embodiment, the rotational axis is in the imaginary plane which includes the plane of the fixation nip. Therefore, the contact pressure and nip width remain stable.

Further, the arms can be equalized relative to the fixation roller. Therefore, even if the arms, heater, fixation roller, etc., are not exact in dimension because of manufacture tolerance, the heater and fixation roller are kept virtually parallel to each other, and therefore, they remain stable in the state of contact.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 317222/2005 filed Oct. 31, 2005 which is hereby incorporated by reference.

What is claimed is:

1. An image heating apparatus comprising:

a rotatable member contactable to a recording material for carrying an image;

a heating member contacted to an outer surface of said rotatable member to heat said rotatable member;

a holding member for holding said heating member; and an urging member for urging said holding member to contact said heating member to said rotatable member, wherein said holding member is rotatable relative to said apparatus about an axis parallel with a generating line of said rotatable member.

2. An apparatus according to claim 1, wherein said axis is provided on a phantom plane including a heating surface of said heating member.

3. An apparatus according to claim 1, wherein the axis is disposed upstream of the heating surface with respect to a rotational direction of said rotatable member.

4. An apparatus according to claim 1, wherein said axis is disposed downstream of the heating surface with respect to a rotational direction of said rotatable member.

5. An apparatus according to claim 1, further comprising a back-up member contacted to an outer surface of said rotatable member, wherein the recording material is fed while being nipped by a nip formed by said rotatable member and said back-up member.

* * * * *